US005279070A

United States Patent [19]

Shreckhise et al.

[11] Patent Number: 5,279,070

[45] Date of Patent: Jan. 18, 1994

[54] PLANT GROWING RECEPTACLE AND METHOD

[76] Inventors: Jerald C. Shreckhise, Rte. 1, Box 617; George W. Shreckhise, P.O. Box 85, both of Weyers Cave, Va. 24486

[21] Appl. No.: 904,009

[22] Filed: Jun. 24, 1992

[51] Int. Cl.[5] ..... A47G 7/00

[52] U.S. Cl. ..... 47/39; 47/41.14; 47/81; 47/66

[58] Field of Search ..... 47/41.14, 79, 81, 39, 47/66, 39

[56] References Cited

U.S. PATENT DOCUMENTS

| | | | |
|---|---|---|---|
| 780,118 | 1/1905 | Mosier | 47/41.14 |
| 1,439,143 | 12/1922 | Buss . | |
| 1,444,666 | 2/1923 | Davis . | |
| 1,879,220 | 9/1932 | Harmony | 47/41.14 |
| 2,486,932 | 11/1949 | Elliott . | |
| 2,792,960 | 5/1957 | Walouke . | |
| 2,810,235 | 10/1957 | Magid | 47/81 |
| 3,661,350 | 5/1972 | Eckler et al. . | |
| 3,733,746 | 5/1973 | Allen, Jr. . | |
| 4,014,506 | 3/1977 | Hanson . | |
| 4,346,532 | 8/1982 | Peterson | 47/66 |
| 4,553,352 | 11/1985 | Powell et al. | 47/66 |
| 4,885,870 | 12/1989 | Fong | 47/81 |
| 4,934,093 | 6/1990 | Yanna | 47/25 RS |
| 5,044,119 | 9/1991 | Hougard | 47/66 |
| 5,107,621 | 4/1992 | Deutschmann, Sr. | 47/79 |
| 5,125,184 | 6/1992 | Anderson | 47/81 |

FOREIGN PATENT DOCUMENTS

| | | | |
|---|---|---|---|
| 0652669 | 12/1964 | France | 47/39 P |
| 1147851 | 4/1969 | France | 47/81 |
| 1400450 | 2/1972 | United Kingdom | 47/81 |
| 2060342 | 5/1981 | United Kingdom | 47/39 |
| 2207591 | 2/1989 | United Kingdom | 47/81 |

OTHER PUBLICATIONS

"Inventor's Workshop: Tree-Support System", *American Nurseryman*, pp. 87 & 90, Jan. 1992.

"Inventor's Workshop: Hexagonal Pot Holders", *American Nurseryman*, p. 115, Feb. 15, 1992.

Adverisement for Aggro System, undated.

"An Alternative Container-Growing System", *American Nurseryman*, by Eileen M. Kaplan, pp. 44–48, May 1, 1992.

*Primary Examiner*—Carl D. Friedman
*Assistant Examiner*—Wynn E. Wood
*Attorney, Agent, or Firm*—Kerkam, Stowell, Kondracki & Clarke

[57] ABSTRACT

A receptacle allows planted pots to be placed above the ground and anchored to the ground. The receptacle is made to allow nesting of one receptacle inside another receptacle. The receptacle has an open-topped cavity in which the potted plant may be placed, still within its pot. Additionally, drainage materials are placed in a lower part of the same cavity and the drainage materials serve to anchor the receptacle to minimize the possibility that wind would blow-over the plant. Further, the cavity has a floor with a hole therein for receiving a stake so as to secure the receptacle to the ground. Additionally, a generally circular support flange extends peripherally around the outside of the receptacle in order to provide greater stability. The receptacle has a conical inner wall which is narrower at its lower end and a conical outer wall which is wider at its lower end. A sheet of insulation may be disposed in the inter-wall space between the inner and outer walls. An external anchor ring may be disposed around the outside of the receptacle to further stabilize it.

19 Claims, 5 Drawing Sheets

PLANT GROWING RECEPTACLE AND METHOD

BACKGROUND OF THE INVENTION

The present invention relates to a plant growing receptacle and associated method. More specifically, the present invention relates to a receptacle for receiving a living plant pot (i.e., a pot in which a living plant is disposed).

There are several different techniques which have been used to sell plants, such as small trees, to a person who wants to place the plant within the ground upon his property.

The person wishing to buy the plant may go to a nursery where the plant is being grown in the ground. However, upon the person selecting the tree or other plant which he desires to purchase, a skilled worker must carefully dig the plant out of the ground, taking care to include the root ball of the plant. If the worker does not include a sufficient portion of the roots of the plant, the plant may die or be damaged significantly. It may not resume growth when it is implanted in the ground at the purchaser's yard. Not only must the worker be careful to include a sufficient quantity of the roots, but the roots usually must be wrapped in burlap and have water applied to them so as to minimize the risk that the roots will cry out before the plant is transplanted. Delay in implanting the plant at its new location can be fatal to the plant. Further, many plants can be effectively transplanted using this technique only during certain times of the year. For example, if a deciduous tree is dug out of the ground after its growing season has started, the plant will likely undergo severe shock, which is often fatal. Finally, this technique is somewhat disadvantageous in that the potential purchaser of such plants must go to a location where the plant is growing in the ground.

As an alternative to having the purchaser select the plant as it grows in the ground, a plant may be dug out of the ground before the consumer has selected the plant. The root ball may be surrounded by burlap and moistened to prevent drying out. The plant could then be placed within a bed of mulch at a location which is remote from the original growing site (and closer to the potential purchaser). However, if the plant is not sufficiently anchored, it may be damaged from blow-over resulting from wind. Further, the roots may go through the burlap if left in place sufficiently long and transplant shock may occur. Although such a technique may lessen the time and skill required to provide the plant to the purchaser upon the purchaser's selection, there is still some time and skill required to remove the plant from the mulch in response to the purchaser's selection. Further, water draining from one plant which is diseased may spread the disease to other plants. Additionally, and like the situation for plants grown in the ground, the purchaser may be reluctant to purchase a plant when it is obvious that the selection has been significantly picked over. For example, if a nursery displays 10 rows of plants, each row having 10 plants in mulch, a purchaser who goes to the nursery after the first 60 plants have been selected may be concerned that all of the good plants have already been taken. The consumer would be able to readily notice that numerous plants have already been taken from the grouping of plants. If a nursery wanted to minimize this risk, the nursery could reorganize the 40 remaining plants as four rows of 10 plants. However, this requires further labor to reorganize the layout of the plants as some plants much be dug out of the mulch and placed back in the mulch at other locations.

Under the circumstances then, the popularity of having nurseries sell plants in containers is readily understandable. When a consumer selects a plant in a container or pot, it may be quickly loaded into the purchaser's vehicle without the need for digging. (Assuming that the plants are grown originally in the pot or container, there is never any need for digging using this technique. However, one might obtain some, but not all of the benefits of pots for the plants by transferring some plants from the ground into pots.) Usually such plants are grown in a soilless rooting medium and are grown above the ground. Most commonly, the pots or containers are made of plastic.

There are numerous other advantages of container or pot grown plants. Usually, more plants can be grown per acre because row spacing for cultivation can be eliminated. The containers or pots prevent roots of adjacent plants becoming intertwined. The trauma of relocating plants, called transplant shock, is eliminated because roots produced remain in the container. The technique is less labor intensive and what labor it uses is mainly unskilled labor. As the plant population may be maintained more densely, the plants are more manageable. Such container-produced plants usually have lighter weight than field-produced plants and this results in increased payloads, thereby reducing freight costs. Unlike field-produced plants, container-produced plants can be sold without concern for the time of the year. In other words, and for example, a deciduous tree may be sold and moved by the purchaser without concern for the fact that the growing season has already started. Container-produced plants usually provide quicker turn-over time from the start to the finished product than field-produced plants. Container-produced plants appeal to garden center operators because of easier maintenance than plants which require burying in mulch or similar steps. Further, plants in pots may be easily rearranged so that purchasers are not discouraged from a picked-over look.

Although container plants have the numerous advantages discussed above, growing and selling plants in pots have numerous disadvantages. Plants, especially trees, in pots will easily upset in a moderate wind unless they are restrained in some fashion. This may cause damage if one plant falls to the ground or falls against another. Such blow over may further cause the loss of expensive fertilizer and potting soil or other materials. A further disadvantage of potted plants is that the root system may be damaged by cold temperatures in the winter. In the summer, the temperature in the soil or soilless rooting medium within the pot may reach such high temperatures that moisture evaporates quickly and growth stops. Under these summer conditions, water is wasted as much of it is used for cooling down the high temperatures of the soil or other rooting medium within the pot. Further, container plants require more water as the water drains and evaporates quickly through the rooting medium. Drainage must be controlled so disease is not transmitted from the run-off water of infected plants.

In addition to the disadvantages noted above, container-produced plants have significant investment costs. The labor and materials for such container-produced plants are concentrated at the beginning of the growing cycle. In view of this front-loading of costs, prudent management of water, fertilizer, etc. is essential. One aspect of this is the need for proper spacing of the plants. This process is costly because it is manually done and must be repeated every year. If the plants are too far apart, the efficiency of the operation is reduced. If the plants are too close together, they may not develop properly.

Numerous techniques have been used to try to minimize the problems associated with container-produced plants, while benefitting from their advantages. For example, the problem of blow-over has been reduced by using guide wires extending from the plant, such as a tree, down to stakes within the ground. Such guide wires may protect against blow-over, but they make it very difficult to move around in the area where the plants are growing. One must be careful to avoid tripping from the guide wires or stakes remaining after removal of the pot. Further, this technique does not address the susceptibility of the root system to damage from temperature extremes.

Another technique has been to pore concrete into a mould and make a six-sided loop which may go around a pot and hold the pot against blow-over. However, this technique does not, in and of itself, provide for proper spacing of the plants. Some plant growing or selling companies have tried to minimize blow-over by poking a hole in the plastic pot in which a plant is disposed and securing it to the ground by use of a stake, such as reinforcing bar (commonly called rebar). This technique does not provide temperature protection.

Yet another technique has involved burying a pot in the ground. Such an empty pot may then receive a pot of the same size in which a plant is disposed. (Generally, such plastic pots used for growing plants are designed to nest, one within the other.) This overcomes many of the problems associated with potted plants, but there are some disadvantages with such a system. In particular, a worker or other person may step into one of the holes if the actual potted plant is removed from the pot which is within the ground. Further, if one wishes to change the spacing in between plants, it may require some time to dig out and move the pots which were within the ground. Additionally, this technique is labor intensive and may require elaborate drainage.

A further arrangement uses a hat-shaped container made of plastic with a hole in the top to hold a container above the ground. The rim of the container sits along the edge of the hole within the top. The hat-shaped container has an open bottom and simply acts as a base to provide a greater width at the bottom of the plant pot. In other words, the plant pot fits within the hat-shaped container or box and the box has an outwardly-extending flange at its base to effectively increase the width of the base. This may somewhat reduce the chances of blow-over, but does not, in and of itself, appear to remedy the problems from temperature extremes and from the annual requirement for manually spacing the potted plants.

Among other disadvantages of many previous systems which have been developed to try to minimize the problems with potted plants are high freight costs. example, the technique described above wherein a concrete ring or loop is placed around the plants either has to be shipped to a particular nursery operation at high expense or the nursery operation must buy a mold and make their own concrete loops on site. Since shipping costs will depend upon the volume as well as the weight of any product which is shipped, techniques which require the use of components taking relatively large amounts of volume are disadvantageous.

OBJECTS AND SUMMARY OF THE INVENTION

Accordingly, it is a primary object of the present invention to provide a new and improved plant growing receptacle and associated method.

A more specific object of the present invention is to provide a plant growing receptacle which maintains the advantages of container-grown plants, while avoiding or minimizing the disadvantages.

A further object of the present invention is to provide a plant growing receptacle which protects against blow-over.

A still further object of the present invention is to provide a receptacle for holding a living plant pot which will protect the root system of the plant against temperature extremes.

A still further object of the present invention is to provide a receptacle for holding a living plant pot and an associated method which reduces the use of water and which minimizes the risk of plant diseases being spread by run-off water.

A still further object of the present invention is to minimize the need for labor, especially skilled labor, for tasks such as proper spacing of plants. Specifically, the present invention minimizes the need for repeating the spacing of the plants for growing and/or moving for winter protection.

A still further object of the present invention is to allow efficient growing of plants, while protecting the money and time invested in plants.

Yet another object of the present invention is to provide a technique whereby spacing between plants may be easily changed.

A still further object of the present invention is to provide a system which will minimize the risk of injuries to workers, which might otherwise occur from stepping into open holes, or bumping into guide wires.

A still further object of the present invention is to allow planting to be done at non-peak times since one need not be concerned about root damage from temperature extremes.

A further object of the present invention is to provide a receptacle for holding plant pots which minimizes freight costs by being relatively light in weight and by having the capability of nesting.

The above and other objects of the present invention are realized by a receptacle for holding a living plant pot. The receptacle has an inner wall extending about a cavity shaped for receiving a living plant pot in at least part thereof. An outer wall extends about the inner wall and is spaced therefrom to define an inter-wall space. The inter-wall space is shaped and sized to allow an inner wall and an outer wall of a like-constructed receptacle to fit therein so as to allow nesting of receptacles in storage and shipment. The outer wall has a lower portion. A floor below the cavity has a securing means directly below the cavity for securing the receptacle to ground. cavity is shaped and sized for receiving a living plant pot in an upper part thereof and for receiving drainage or ballast materials in a lower part thereof. The receptacle may further have a living plant pot in the upper part of the cavity and drainage materials in the lower part of the cavity. The securing means is a hole in the floor, the hole adapted to receive a stake therethrough. (The securing means might alternately be a stake or post which is part of the receptacle or might be a loop or other arrangement for receiving a stake.) The floor has a generally upwardly and inwardly extending part and the hole is in the extending part. The stake may be rebar extending through the hole. The inner wall is tapered inwardly towards a lower end thereof and the outer wall is tapered outwardly towards its lower portion. The inner wall is conically shaped and the outer wall is conically shaped. Insulation may be disposed in the inter-wall space. More specifically, a flexible sheet of insulation may be disposed therein. A support flange at the lower portion of the outer wall extends outwardly therefrom and is adapted to support the receptacle with the support flange resting on a generally horizontal surface. An external anchor ring may be removably disposable around the lower portion of the outer wall to further secure the receptacle to the ground. Each of the inner and outer walls has a circular horizontal cross-section.

The present invention may alternately be described as a receptacle having an inner wall extending about a cavity shaped for receiving a living plant pot in an upper part thereof and for receiving drainage materials in a lower part thereof. An outer wall extends about the inner wall and is spaced therefrom to define an inter-wall space. The inter-wall space is shaped and sized to allow an inner wall and an outer wall of a like-constructed receptacle to fit therein so as to allow nesting of receptacles in storage and shipment. The outer wall has a lower portion. A floor is directly below the cavity. A support flange at the lower portion of the outer wall extends outwardly therefrom and is adapted to support the receptacle with the support flange resting on a generally horizontal surface. The inner wall is conically shaped and gets narrower at a lower end thereof. The outer wall is conically shaped and gets wider at its lower portion.

The method of the present invention is a method of arranging potted plants for growing and/or display purposes. The steps of the method include placing a series of stakes vertically in the ground with spacing dependent on desired inter-plant distance. A plurality of receptacles are secured to the stakes and above the ground, the receptacles being of the type described above. Although it is highly preferred that the stakes be placed in the ground before the receptacles are secured to the stakes, the present invention, in its broadest aspects, contemplates that the stakes would be secured to the receptacles and then the stakes would be placed in the ground. A pot having a living plant therein is placed in the cavity of each of several of the receptacles. The method may further include the placing of drainage materials (small stones, gravel, or other drainage materials commonly used) in the lower part of each cavity before placing a pot in that cavity. The securing step for each receptacle is accomplished by having a stake extend through the securing means of that receptacle. The method may further include disposing insulation in the inter-wall space of each receptacle.

BRIEF DESCRIPTION OF THE DRAWINGS

The above and other objects and features of the present invention will be more readily understood when the following detailed description is considered in conjunction with the accompanying drawings wherein like characters represent like parts throughout the several views and in which.

DETAILED DESCRIPTION

Figure 1:
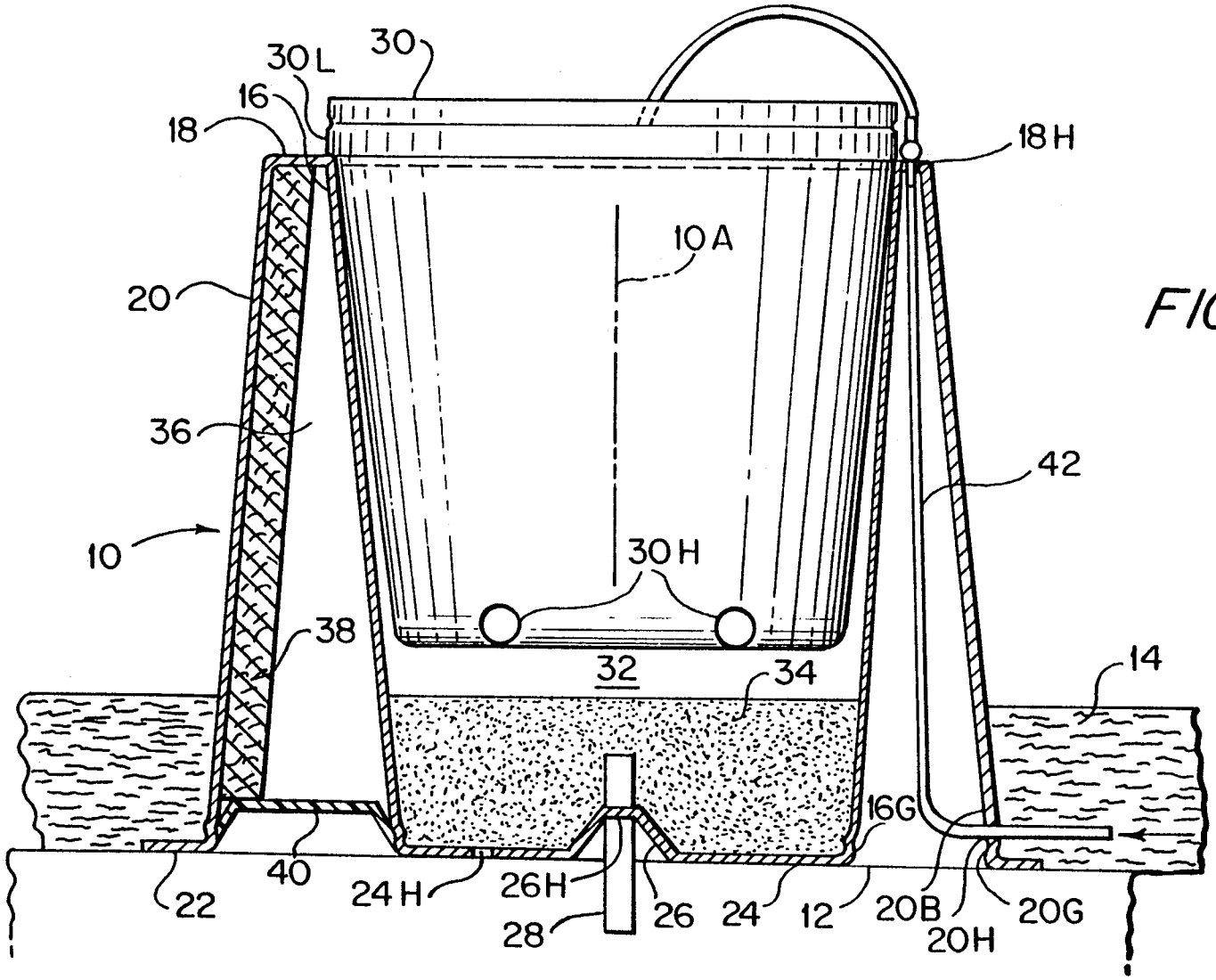
FIG. 1 shows a cross-section front view of a first embodiment of the present invention with a standard pot mounted therein and with the present invention anchored to the ground.

FIG. 1 shows a receptacle 10 according to the present invention secured above the ground 12 and having a layer of mulch 14 surrounding it. The receptacle 10 is circularly symmetric about a central axis 10A. The receptacle 10 has an inner wall 16 which is conically shaped and gets narrower at its lower end. An upper ledge 18 connects the inner wall 16 to an outer wall 20 which is conically shaped and gets wider adjacent to its lower portion 20B. A support flange 22 extends outwardly (i.e., away from central axis 10A) from the lower portion 20B and supports the receptacle 10 upon the ground 12 or a similar generally horizontal surface. The support flange 22 extends circumferentially around the circular lower portion 20B and is in the shape of a ring.

The inner wall 16 extends down to a floor 24 having a generally upwardly and inwardly extending part 26 centered about central axis 10A and having a hole 26H centered therein for receiving a stake such as rebar 28. The shape of 26 allows one to easily place the receptacle 10 down upon the rebar 28 with the surfaces of portion 26 facilitating minor position adjustments as the receptacle 10 is lowered onto the rebar 28 such that rebar 28 extends through the hole 26H. Further, the shape of 26 facilitates easily placement on rebar 28, but tends to resist removal of the receptacle 10 from rebar 28. Note also that one might optionally use serrated edges and/or fingers (not shown) at the side of hole 26H so that receptacle 10 resists removal from rebar 28. One might use a clamp (not shown) on the top of the rebar 28 to prevent the receptacle 10 from sliding up rebar 28. One would still be able to remove it, but the chances of wind blowing over the receptacle 10 would be greatly diminished.

The open-topped cavity 32 within the inner wall 16 and above the floor 24 is shaped and sized to hold a conventional pot 30, commonly used for growing plants. The pot 30 includes an outer lip portion 30L which rests upon the ledge 18 such that the pot 30 is disposed sufficiently above the floor 24 as to allow the lower part of the cavity 32 to hold gravel, sand, or other ballast materials 34, at the same time as the pot 30 is disposed in the upper part of cavity 32. Optionally, one might have ledge 18 stepped (not shown) so that the top of pot 30 is recessed down into receptacle 10. The conventional pot 30 may include holes 30H on its side and additional holes (not shown) on its bottom to allow excess water to drain out of the pot 30. Such water may pass out of the drainage providing ballast materials 34 by way of holes such as 24H (only one shown) which may be arranged circumferentially around parts of the floor 24 or around the lower end of wall 16.

As clearly shown in FIG. 1, the floor 24 bounds the lower end of the cavity 32 and the inner wall 16 extends down to, and supports, the floor 24. As also shown in FIG. 1, the hole 26H serves as a securing means to secure the floor 24 in position which in turn secures the inner wall 16.

receptacle of FIG. 1 has several features which eliminate or greatly reduce the possibility of blow-over. In particular, the widening of the outer wall 20 towards its lower portion 20B provides resistance to the possible tipping of the plant due to wind or otherwise. Further, the support flange 22 would resist any such tipping. The rebar 28 cooperates with the hole 26H to secure the receptacle 10 against tipping, the hole 26H serving as a securing means. Further, the gravel or sand 34 disposed in the lower part of cavity 32 serves to ballast or secure the receptacle 10 against movement.

As shown in FIG. 1, the inner wall 16 is separated from the outer wall 20 by an inter-wall space 36. This space 36 may serve to insulate the inner wall 16 and any plant within the pot 30 from temperature extremes. Specifically, the air within space 36 will tend to lessen the possibility that cold winds blowing against outer wall 20 would cause damage to the roots of any plant within the pot 30. Additionally, the air within space 36 and the separation between inner wall 16 and outer wall 20 will reduce the risk of heat damage to the roots of a plant within pot 30. Sun shining directly on outer wall 20 may tend to heat up the outer wall, but that heat will be somewhat separated from the inner wall 16 by the space 36.

Although the separation between the inner wall 16 and outer wall 20 may provide sufficient insulation to avoid damage from temperature extremes in certain climates (especially considering that inter-wall space 36 captures the earth's moderating thermal energy) and for certain plants (some plants are more sensitive than others to temperature extremes), the present invention further includes an arrangement whereby insulation 38 may be disposed within the inter-wall space 36. As illustrated in FIG. 1 (left side only, not shown on right side for ease of illustration), the insulation 38 may be a flexible sheet of insulation. The sheet 38 could be a foamed resilient material which normally lies flat. When the sheet 38 is wrapped as a ring within the inter-wall space 36, the resilience of the sheet 38 pushes it out against the outer wall 20 and tends to hold it within the inter-wall space 36. Optionally, a retaining ring 40, preferably made of plastic, may snap into opposing circular grooves 16G and 20G disposed respectively on the inner and outer walls 16 and 20. The snap ring 40 may help to hold the insulation 38 in place.

As an alternative to the flexible sheet 38 of insulation, the insulation might alternately be of the same cross-section as shown for insulation 38, but be constructed of a rigid piece of foamed polystyrene (such as commonly sold under the STYROFOAM trademark) or other rigid insulation in a hollow conical shape so that it just fits within the inside surface of the outer wall 20. Alternately, insulation could be foamed in place within space 36 or other insulation materials, such as chips of foamed polystyrene (not shown) could be placed within the inter-wall space 36 and trapped therein by the ring 40 which closes off the bottom of the inter-wall space 36. For ease of illustration, FIG. 1 has simply shown ring 40 at the left side of the central axis 10A, but it will be understood that ring 40 is circularly symmetric about axis 10A.

The right side of FIG. 1 shows how a water line 42 may go through a hole 20H in outer wall 20 and through a hole 18H in upper ledge 18 in order to supply water to within the pot 30.

Figure 2:
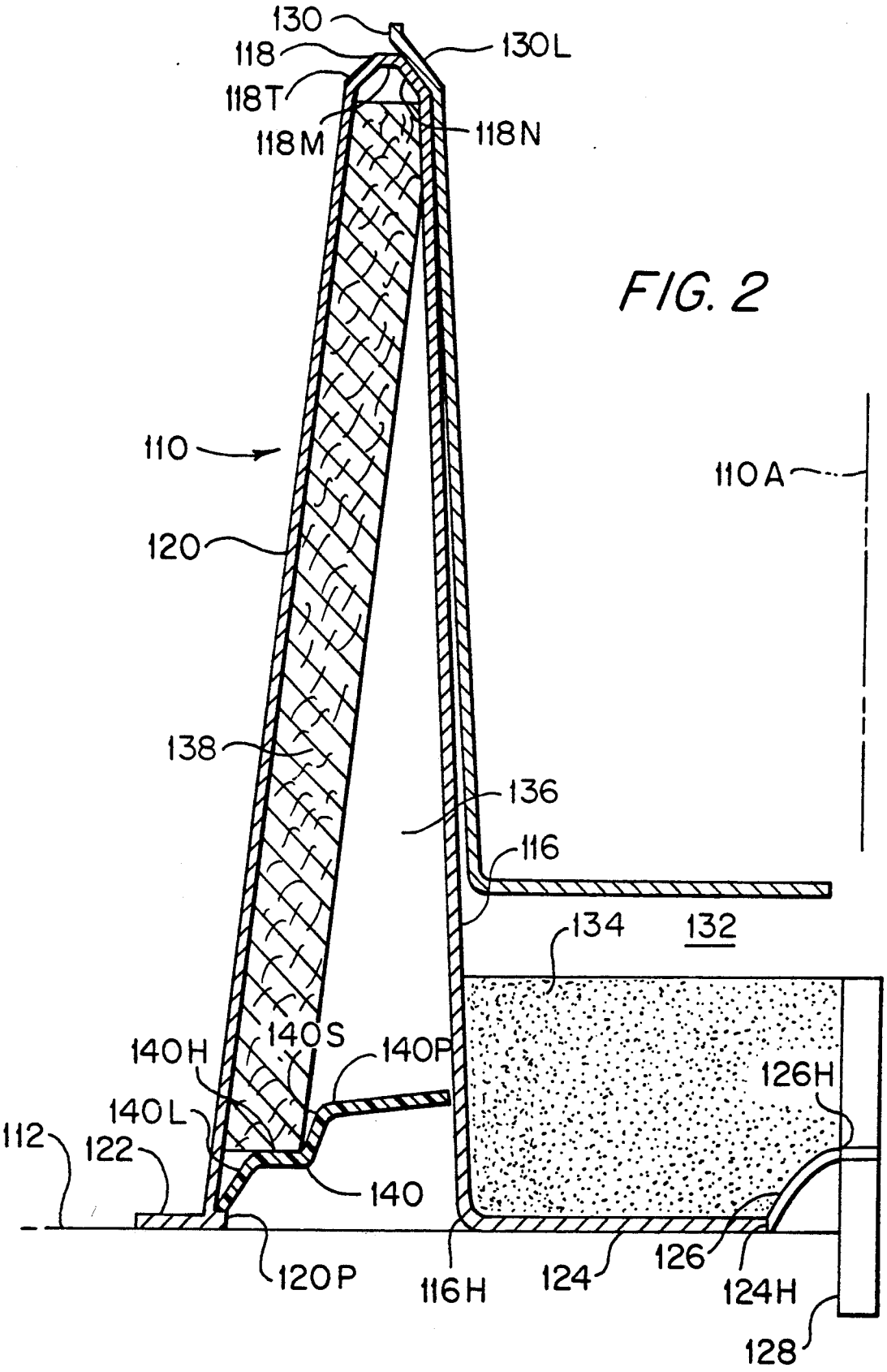
FIG. 2 shows a cross-section side view of a part of a second embodiment receptacle according to the present invention.

Turning now to FIG. 2, a second embodiment receptacle 110 will be discussed. The components shown in FIG. 2 have the same last two digits as the corresponding component in FIG. 1 and the discussion which follows will emphasize the differences. The receptacle 110 is circularly symmetric about axis 110A and, for ease of illustration, FIG. 2 only shows a portion of the receptacle 110 having a container 130 held in the upper part of cavity 132 by the lip 130L mating with a portion of the ledge 118. As shown, the ledge 118 may include a middle portion 118M separating oppositely inclined outer and inner portions 118T and 118N respectively.

For drainage purposes, the inner wall 116, which is conically shaped and narrower at its lower end may include drainage holes 116H (only one shown) to allow drainage of any excess water within drainage materials 134 disposed within the lower portion of cavity 132. The bottom of open-topped cavity 132 is determined by the floor 124 which may include a drainage hole such as 124H. Centrally located within the floor 124 is an upwardly and inwardly curved part 126 having a convex upper surface and a concave lower surface and extending generally in a ring around a hole 126H which accommodates rebar 128 in similar fashion as described with respect to FIG. 1. However, as the curved part 126 is more easily moved up by insertion of the rebar 128 and is more resistent to bending in the opposite direction upon attempted removal of the rebar 128, the hole 126H facilitates easy insertion of rebar 128 and resists blow over of the plant within pot 130.

As shown in FIG. 2, a flexible sheet of insulation 138 may be disposed in the inter-wall space 136 between the inner wall 116 and the outer wall 120. For holding the optional insulation 138 in place, an optional snap ring 140 may be snapped into place by pushing it past a series of projections 120P (only one shown) which are secured to the inner surface of outer wall 120. The projections 120P may each be about one or two inches long and there may be three or four such projections (or a 360° projection could be used) circumferentially arranged around the inside of outer wall 120. Other arrangements could of course be used for snapping the ring 140 in place. As shown, the ring 140 includes a lower portion 140L which is conical and connects to a generally horizontal portion 140H. Portion 140H defines, together with an adjacent second conical section 140S, a zone in which the lower portion of insulation sheet 138 will be trapped. This will help hold the insulation 138 against the outer wall 120. Above the second conical portion 140S is an upper portion 140P which extends over to contact the outer surface of inner wall 116. The incline on portion 140L allows easy snapping of the ring 140 in place. To remove the ring 140, one may simply pry back the portion 140L using a screwdriver adjacent to each of the projections 120P.

A support flange 122 is mounted at the lower portion of outer wall 120.

Figure 3:
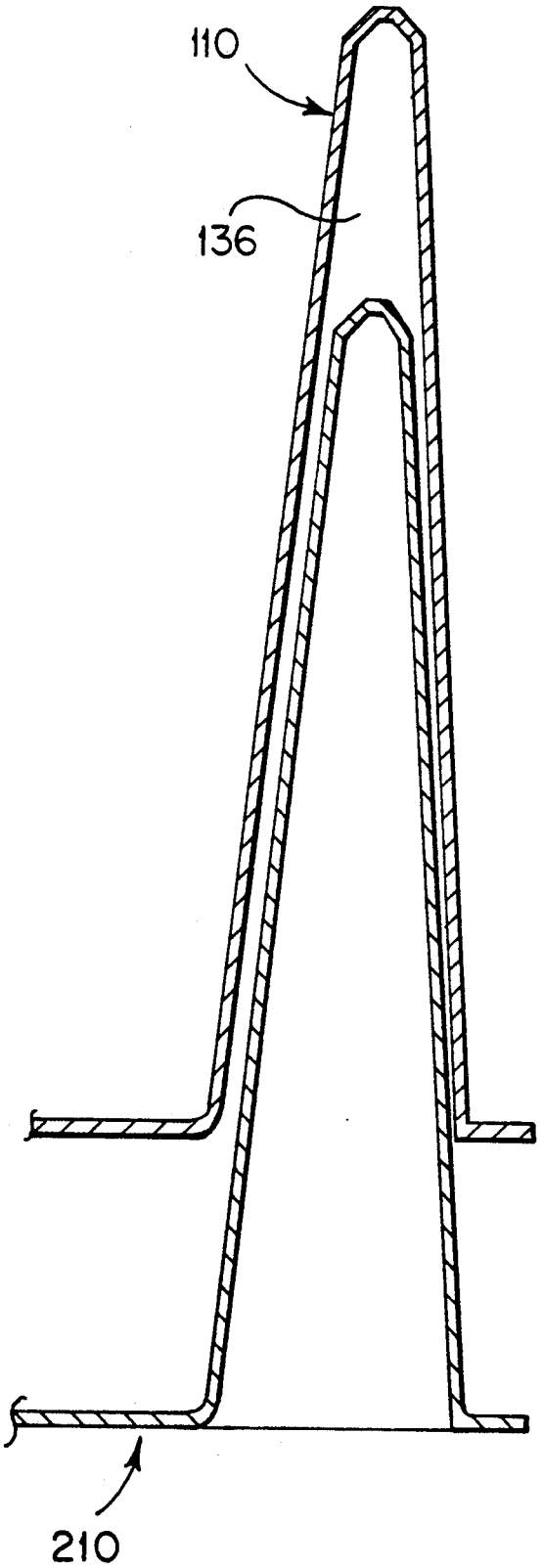
FIG. 3 shows a cross-section view illustrating the nesting of the receptacle of FIG. 2 within a like-constructed receptacle.

Turning now to FIG. 3, a receptacle 210, constructed identically to receptacle 110 is shown nested within the inter-wall space 136. The insulation sheet 138 of FIG. 2 and the ring 140 of FIG. 2 have been removed from the receptacle 110. Moreover, the insulation sheet 138 and ring 140 are optional and need not be included in order to realize the broadest aspects of the present invention. In any case, the receptacle 210 may readily nest within the receptacle 110 and this is highly advantageous in holding down the freight cost since a much larger number of receptacles may be carried in a truck when the receptacles have the nesting ability as illustrated. If desired, the optional insulation sheets 138 and rings 140 may also be packed tightly and the purchaser of the receptacles 110 and 210 may simply place the flexible insulation sheet 138 (not shown in FIG. 3) within the inter-wall space and snap the ring 140 in place.

Although FIG. 3 shows the nesting of the embodiment of FIG. 2, it will be readily appreciated that the embodiment or receptacle 10 of FIG. 1 may be readily nested in the same fashion as illustrated for FIG. 3.

Figure 4:
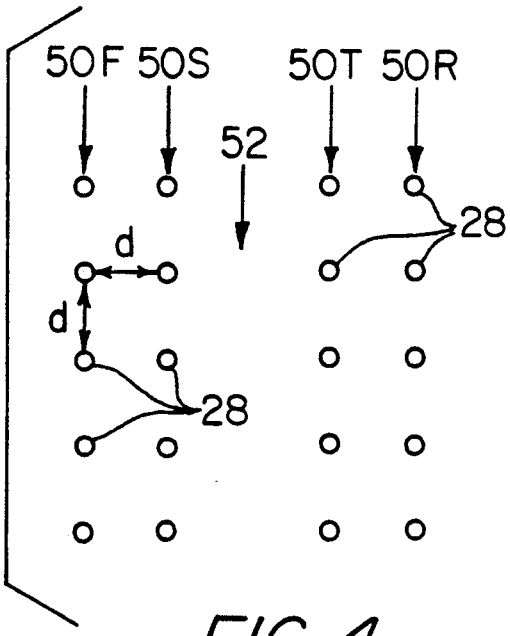
FIG. 4 shows a series of spaced stakes as may be used with the present invention.

Turning now to FIG. 4, the rebar 28 used as stakes with the present invention may be arranged in first, second, third, and fourth columns 50F, 50S, 50T, and 50R respectively. Each of the columns has six of the rebar stakes 28 disposed therein. For ease of illustration only a few of the rebar stakes 28 are labeled. This top view of FIG. 4 further illustrates how a path 52 may be disposed in between adjacent columns 50S and 50T so that someone may have access to the plants. Such a path may be disposed in between every two or three columns, or may not be used depending upon the circumstances. FIG. 4 also illustrates that the distance between adjacent rebar stakes 28 is d, which is determined by the requirements of the plant which is being grown.

By laying out the rebar 28 in a regular pattern such as illustrated in FIG. 4, one need not be concerned about spacing the plants at a later time. After the rebar is placed within the ground in a pattern such as in FIG. 4, receptacles such as 10 of FIG. 1 or 110 of FIG. 2 may be secured to each of the stakes and mulch may be placed around the receptacles. Unskilled labor may be used to place the various plants within the receptacles arranged in an array corresponding to the stakes 28 shown in FIG. 4. Before placing the potted plants within each of the receptacles, ballast or drainage materials would be placed in the receptacles if needed.

An advantageous feature of the present invention may be discussed with reference to FIG. 4. Initially, assume that a garden center has 24 plants disposed in the four columns 50F, 50S, 50T, and 50R with corresponding receptacles (not shown in FIG. 4) arranged in the pattern illustrated for the rebar 28. Upon selling 12 of those plants, selected at random from the arrangement by consumers, consumers or other potential purchasers may be turned off by the picked-over appearance of the remaining plants. That is, in a situation where two plants are missing from one column and three plants are missing from another, etc., the potential purchaser may feel that the best plants have already been sold. However, unskilled labor may be used to simply rearrange the 12 remaining plants so that they are all disposed in the first and second rows 50F and 50S. To accomplish such a rearrangement, the worker for the garden center may simply lift the plants out of receptacles corresponding to columns 50T and 50R and move the plants, within their pots, into receptacles corresponding to rows 50F and 50S. Empty receptacles could be removed and nested. Persons are now more likely to buy the remaining plants.

Figure 5:
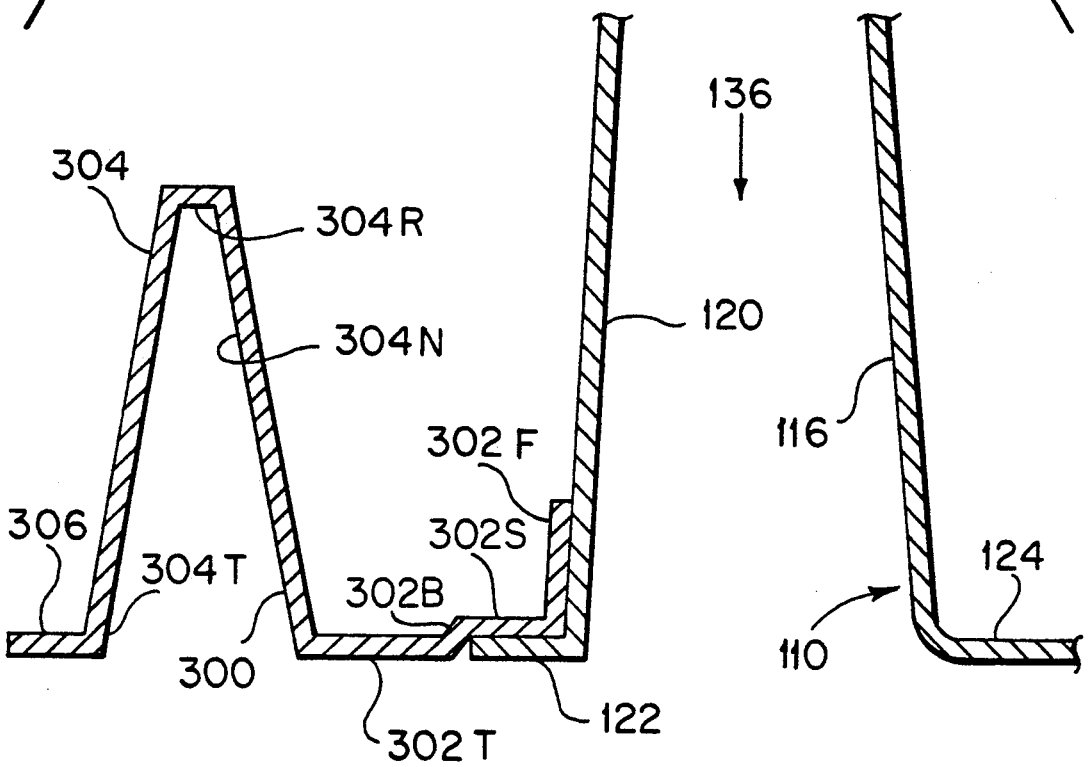
FIG. 5 shows a cross-section view of a first embodiment external anchor ring according to the present invention.

Turning now to FIG. 5, an optional external anchor ring will be discussed. Specifically, the anchor ring 300 may be circularly symmetric and extend around and on top of the support flange 122 of receptacle 110. (The external anchor ring 300 might also be used with the receptacle 10 of FIG. 1.) The anchor ring 300 includes a first portion 302F which is either vertical or conical so as to mate with the outside of outer wall 120 of receptacle 110. The portion 302F is connected to a generally horizontal portion 302S designed to sit on top of the flange 122. This second portion 302S is connected to a third portion 302T by way of a downward bend 302B.

A ridge 304 has an inner wall 304N connected to an outer wall 304T by way of a ledge 304R. A support flange 306 is disposed around the outer periphery of the lower portion of outer wall 304T and functions in similar fashion to the support flange 122 and support flange 22 (FIG. 1 only). The ring 300 may be used in circumstances where the receptacle 110 will be subject to higher than usual winds or may be used for particular plants which are especially susceptible to blow-over. Specifically, the ring 300 may simply be slid down upon the receptacle 110. Ballast materials such as stone or gravel may be placed between the inner ridge wall 304N and the outer wall 120 and this will further serve to anchor the receptacle 110.

Figure 6:
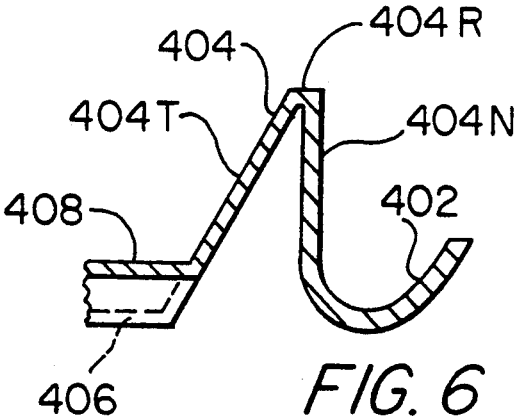
FIG. 6 shows a cross-section of a second embodiment external anchor ring.
Figure 7:
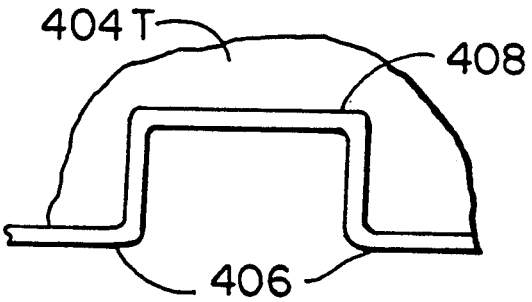
FIG. 7 shows a side view of a part of the ring of FIG. 6.

Turning now to FIGS. 6 and 7, an alternate ring 400 is shown. Ring 400 functions like ring 300 and has ridge 404 having outer wall 404T, ledge 404R, and inner wall 404N. Portion 402 is shaped differently than the parts of ring 300. Ring 400 has three hand holds 408 (only one shown) disposed up from flange 406 so as to ease picking up of ring 400. The hand holds 408 would be spaced around the periphery of the ring.

The manner in which the present invention advantageously avoids problems common to previous designs will now be discussed.

The design of the present invention protects against moderately high wind by offering a wider base for the container plant. It also offers an inner cavity or lower part of cavity such as 32 of FIG. 1 or 132 of FIG. 2 which may be filled with ballast to offset pressure applied by the wind to the plant within the pot. The steel rod such as rebar 28 or 128 not only allows precise placement of the plants, but also greatly increases stability of the receptacle 10 or 110. Further, the optional external anchor ring such as 300 of FIG. 5 or 400 of FIG. 6 may be used to further increase the effective width of the base and to further secure the receptacle by being filled with ballast such as stones or gravel.

The present invention offers the root system nearly equivalent growing conditions as field grown plants. The temperature of the rooting medium does not fluctuate as drastically as in unprotected containers. In the cold climates, soil temperatures lower gradually because the container is protected by insulation on the sides and bottom. In the warmer climates, the insulation offers the same protection from rapid build-up of heat in the rooting medium. Water is greatly conserved because evaporation losses are reduced by this lower temperature of the rooting medium.

Drainage is facilitated by having the container position slightly above the ground. Therefore, water which has run off one of the plants is highly unlikely to infect another of the plants.

The present invention further allows money to be saved because the device will conserve water and this in turn conserves fertilizer. Money is also conserved in that plants will not be damaged from blowing over. Labor costs incurred annually for proper spacing of the plants can be eliminated after the initial set-up of these receptacles. In other words, once the arrangement such as FIG. 4 has been made, this should last for quite a few years without the need for reestablishing such a layout. Costs are also conserved because the plants may be able to go through the winter within the pots. (Depending upon the climate, one might want to put up a tent-like structure to protect them from snow.) Because plant root systems are protected, earlier placement within containers can be facilitated. This allows planting to be done at nonpeak times. Earlier planting permits the advantage of having the plant available for the first of the growing season. The present device may advantageously be used for both growing plants and for displaying them at retail garden centers. The present arrangement is easily installable, provides better drainage, is easily changed to different spacing, and can be used on virtually any flat surface. The blow-molded design was carefully engineered to stack or nest one into another, making shipping costs lower. Turning back briefly to FIG. 1, the receptacle 10 may be blow-molded of any type of plastic as commonly used for standard plant pots. The receptacle 10 may be made from a single piece except that the optional insulation sheet 38 and optional ring 40 (also formed of plastic such as commonly used for plant pots) would be made separately. The receptacle 110 of FIG. 2 would be made in the same manner as discussed with respect to receptacle 10. The anchor rings 300 and 400 of FIGS. 5 and 6 would likewise be made of a formed plastic of a type commonly used for plant pots.

Figure 8:
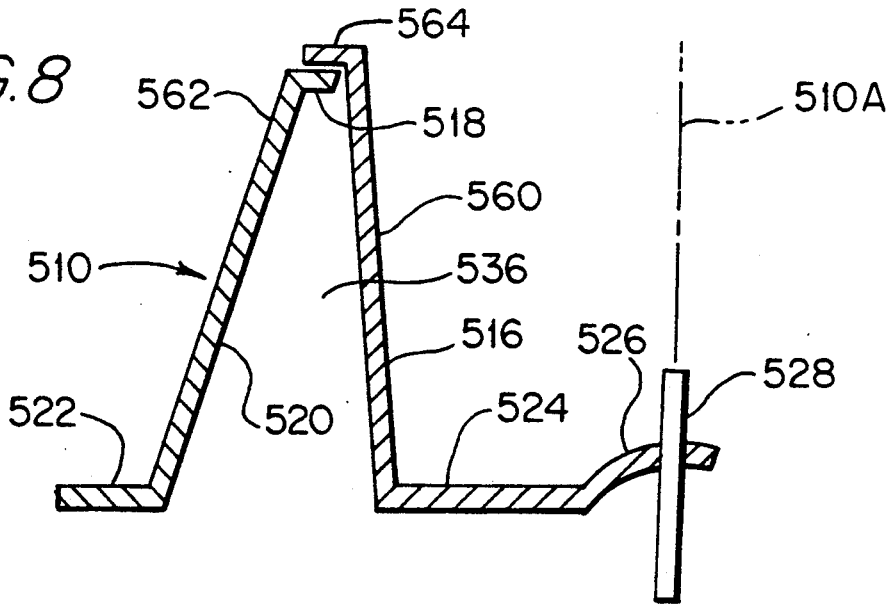
FIG. 8 shows a simplified cross-section view of a third embodiment receptacle of the present invention.

Turning now to FIG. 8, a third embodiment receptacle 510 according to the present invention will be discussed. The receptacle 510, which is circularly symmetric about axis 510A has components with the same last two digits as the corresponding component, if any, in the first two embodiments, the numerals being in the five hundred series. A floor 524 may be locked to a stake or rebar 528 in the same fashion as discussed with respect to the previous two embodiments. For ease of illustration, only the cross-section of the left side of the receptacle 510 is shown. The receptacle 510 is different than the previous receptacles in that the floor 524 is part of an inner piece 560 which rests upon a circular inwardly extending flange 518 which is part of a separate outer piece 562. The inner piece 560 further includes the inner wall 516 and a circular outwardly extending flange 564 which rests upon the flange or ledge 518 of piece 562. Piece 562 further includes the outer wall 520 and the support flange 522. The operation of the receptacle 510 of FIG. 8 is essentially the same as the operation of the previously discussed receptacles. The difference in receptacle 510 is basically that the inner and outer walls are parts of separate pieces. The piece 562 may be placed around the rebar 528 so that the rebar 528 is approximately centered. At that stage, the piece 560 may be pushed down in the piece 562 and the rebar 528 will center the piece 560 by the curved portion 526 and will also center the outer piece 562 as the edge of flange 518 adjusts to the downward pushing of the outer surface of inner wall 516. Drainage holes may be included in piece 560, but are not shown for ease of illustration.

Although not shown in FIG. 8, it will be apparent that the receptacle 510 has the same ability to nest as previously discussed with respect to the first and second embodiments of the present invention. Specifically, the inter-wall space 536 is shaped and sized to allow a like-constructed receptacle to be nested therein. Such a nesting, not shown, would result in a series of flanges 564 alternately disposed between a series of flanges 518, each flange 518 separated from an adjacent flange 518 by a flange 564. Although the receptacle 510 may be nested with inner piece 560 resting upon outer piece 562, one might alternately nest a series of inner pieces 560 together resting upon a series of outer pieces 562 nested together. Further, one might nest the pieces 560 separately from a nesting of the pieces 562. However, it is believed that the interleafing of the flanges 564 and 518 would be the most efficient way to nest the receptacles such as receptacle 510 for shipment or storage.

Although not shown in FIG. 8, a series of different inner pieces 560 might be used with different sized flanges 564 such that all of the different sized inner pieces 560 would be supported by a single design outer piece 562. Each of the various inner pieces 560 could be shaped to receive a different-sized plant pot such as 30 of FIG. 1.

Figure 9:
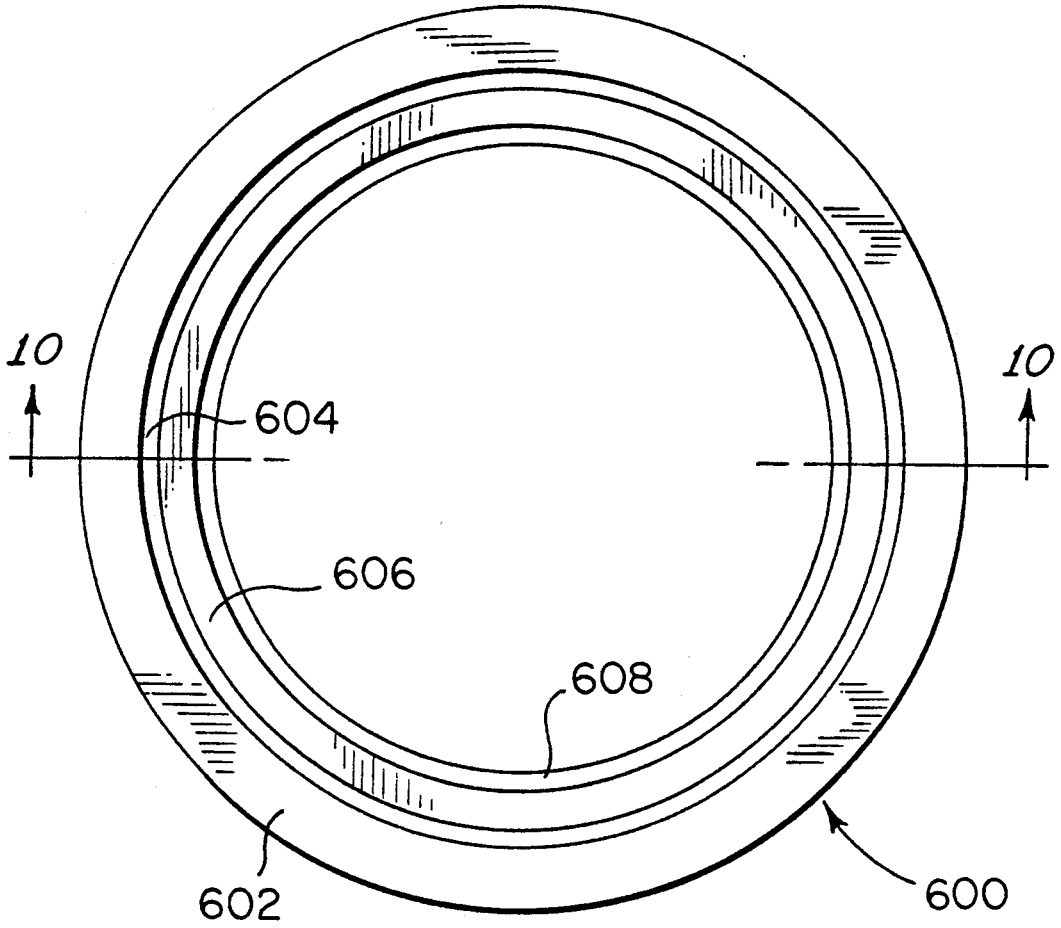
FIG. 9 shows a top view of an adapter ring.
Figure 10:
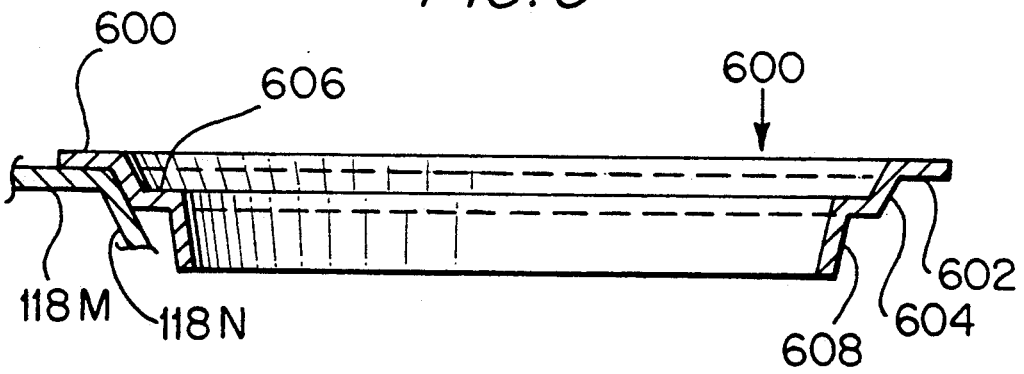
FIG. 10 shows a cross-section view taken along lines 10—10 of FIG. 9.

Turning now to FIGS. 9 and 10, an adapter ring 600 is shown. The adapter ring 600 may optionally be mounted upon portions 118N and 118M (only partially shown in FIG. 10 only) of the receptacle 110 (refer back momentarily to FIG. 2). The adapter ring 600 has an outer ring 602 which rests upon portion 118M, an inwardly and downwardly extending conical surface 604 which rests upon portion 118N, an inner ring 606, and an inner downwardly extending conical portion 608. By placing the adapter ring 600 in one of the receptacles designed according to the present invention, such as receptacle 110 of FIG. 2, the receptacle may be adapted to hold a plant pot which would otherwise be too small to fit on portions 118M and 118N of the receptacle 110. Such a plant pot, not shown, would instead fit on portions 606 and/or 608 of adapter ring 600, the adapter ring 600 in turn fitting on portions 118M and 118N.

Advantageously, the various receptacle designs according to the present invention provide for the elevation of the pot off the ground. With reference back to FIG. 1, having the bottom of the pot 30 separated from the ground 12 by four inches will provide protection for the plant against drowning and will avoid disease transmission from run off water from any nearby diseased plant. This separation from the bottom of the pot to the ground (upon which the floor 24 rests) should be at least one inch and preferably at least two inches. More preferably, this separation distance will be at least four inches. Thus, the lower part of cavity 32 (i.e., the part of cavity 32 which may be used for ballast materials) will be at least one inch in height, preferably at least two inches, and even more preferably at least four inches in height.

An important advantage of the present invention is that the mulch 14 in FIG. 1 would insulate the lower portion of the receptacle 10. Under the circumstances, and even without the optional ring 40 and optional insulation 38, the inter-wall space 36 will follow the temperature of the ground 12 just below the inter-wall space 36. That portion of the ground 36 moderates temperature extremes since the ground itself tends to moderate temperature extremes and since the mulch 14 tends to insulate that portion of the ground 12 which is just below the inter-wall space 36. This feature of having the inter-wall space 36 track the generally moderate temperatures of the ground or earth (such that the pot and plant roots track the moderate ground temperatures) will reduce the chances that a plant would be damaged by especially hot or especially cold conditions. Further, this moderation of temperature extremes may improve the growing of any plant within the pot 30. Although the feature of having the interwall space 36 track the moderate temperatures of the earth has been discussed with respect to the embodiment of FIG. 1, this feature, like the protection against drowning and disease transmission provided by the separation between the bottom of the pot and the floor of the receptacle, will be present in the other embodiment receptacles of the present invention.

As an alternative to the described designs, one could make floor 24 without holes 24H (see FIG. 1) and use water as the material 34 within the lower part of cavity 32. A wick (not shown) could be used to convey the water from the lower part of cavity 32 to the pot. A seal (not shown) around hole 26H could prevent leakage or, alternately, the design could be used without hole 26H as, for example, in displaying plants inside a building.

Although various specific constructions and embodiments have been illustrated herein, it is to be understood that these are for illustrative purposes only. Various modifications and adaptations will be apparent to those of skill in the art. Accordingly, the scope of the present invention should be determined with reference to the claims appended hereto.

What is claimed is:

1. A receptacle for holding a living plant pot and comprising:

an inner wall extending about a cavity shaped and sized for receiving a living plant pot in an upper part thereof and for receiving ballast materials in a lower part thereof;

an outer wall extending about said inner wall and spaced therefrom to define an inter-wall space, wherein said inter-wall space is shaped and sized to allow an inner wall and an outer wall of a like-constructed receptacle to fit therein so as to allow nesting of receptacles in storage and shipment, said outer wall having a lower portion;

a floor below said cavity, said floor bounding a lower end of said cavity and having securing means directly below said cavity for securing said floor in position which in turn secures said inner wall; and wherein said inner wall extends down to, and supports, said floor.

2. The receptacle of claim 1 having a living plant pot in said upper part of said cavity and having ballast materials in said lower part of said cavity.

3. The receptacle of claim 1 wherein said securing means is a hole in said floor, said hole adapted to receive a stake therethrough.

4. The receptacle of claim 3 wherein said floor has a generally upwardly and inwardly extending part and said hole is in said extending part.

5. The receptacle of claim 4 further comprising rebar extending through said hole.

6. The receptacle of claim 3 wherein said inner wall is tapered inwardly towards a lower end thereof and said outer wall is tapered outwardly towards its lower portion.

7. The receptacle of claim 6 wherein said inner wall is conically shaped and said outer wall is conically shaped.

8. The receptacle of claim 6 further comprising insulation disposed in said inter-wall space.

9. The receptacle of claim 8 wherein said insulation is a flexible sheet of insulation.

10. The receptacle of claim 1 further comprising a support flange at said lower portion of said outer wall extending outwardly therefrom and adapted to support said receptacle with the support flange resting on a generally horizontal surface.

11. The receptacle of claim 1 further comprising an external anchor ring removably disposable around said lower portion of said outer wall to secure the receptacle.

12. The receptacle of claim 1 wherein each of said inner and outer walls has a circular horizontal cross-section.

13. A receptacle for holding a living plant pot and comprising:

an inner wall extending about a cavity shaped and sized for receiving a living plant pot in an upper part thereof and for receiving materials in a lower part thereof;

an outer wall extending about said inner wall and spaced therefrom to define an inter-wall space, wherein said inter-wall space is shaped and sized to allow an inner wall and an outer wall of a like-constructued receptacle to fit therein so as to allow nesting of receptacles in storage and shipment, said outer wall having a lower portion;

a floor directly below said cavity and bounding a lower end of said cavity; and a support flange at said lower portion of said outer wall extending outwardly therefrom and adapted to support said receptacle with the support flange resting on a generally horizontal surface; and wherein the floor has securing means directly below said cavity for securing the receptacle to the generally horizontal surface and wherein said cavity is shaped and sized for receiving a living plant pot in an upper part thereof and for receiving drainage materials in a lower part thereof, and wherein said securing means is a hole in said floor, said hole adapted to receive a stake therethrough.

14. The receptacle of claim 13 wherein said inner wall is conically shaped and gets narrower at a lower end thereof, and said outer wall is conically shaped and gets wider at its lower portion.

15. The receptacle of claim 13 wherein said floor has a generally upwardly and inwardly curved part and said hole is in said curved part.

16. A method of arranging potted plants, the steps, not necessarily in order, comprising:

placing a series of stakes vertically in the ground with spacing dependent on desired interplant distance;

securing a plurality of receptacles to at least some of the stakes and above the ground, each receptacle including an inner wall extending about a cavity shaped and sized for receiving a living plant pot in an upper part thereof and for receiving ballast materials in a lower part thereof;

an outer wall extending about said inner wall and spaced therefrom to define an inter-wall space, wherein said inter-wall space is shaped and sized to allow an inner wall and an outer wall of a like-constructed receptacle to fit therein so as to allow resting of receptacles in storage and shipment, said outer wall having a lower portion, a floor below said cavity, bounding a lower end of said cavity, and having securing means directly below said cavity for securing said floor to a generally horizontal surface which in turn secures said inner wall; and wherein said cavity is shaped and sized for receiving a living plant pot in an upper part thereof and for receiving drainage materials in a lower part thereof;

and placing a pot having a living plant therein in said cavity of each of several of said receptacles.

17. The method of claim 16 further comprising the step of placing ballast materials in a lower part of each cavity before placing a pot in that cavity.

18. The method of claim 16 wherein said securing step for each receptacle is accomplished by having a stake extend through the securing means of that receptacle, which securing means is a hole in the floor of that receptacle.

19. The method of claim 18 further comprising the step of disposing insulation in said inter-wall space of each receptacle, and wherein each receptacle has a support flange at said lower portion of said outer wall extending outwardly therefrom and adapted to support said receptacle with the support flange resting on the ground, and wherein, for each receptacle, said inner wall is conically shaped and gets narrower at a lower end thereof, and said outer wall is conically shaped and gets wider at its lower portion.

* * * * *